US007606377B2

(12) United States Patent
Melanson

(10) Patent No.: US 7,606,377 B2
(45) Date of Patent: Oct. 20, 2009

(54) METHOD AND SYSTEM FOR SURROUND SOUND BEAM-FORMING USING VERTICALLY DISPLACED DRIVERS

(75) Inventor: John L. Melanson, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 465 days.

(21) Appl. No.: 11/421,381

(22) Filed: May 31, 2006

(65) Prior Publication Data

US 2007/0263888 A1 Nov. 15, 2007

Related U.S. Application Data

(63) Continuation-in-part of application No. 11/383,125, filed on May 12, 2006, now Pat. No. 7,545,946.

(51) Int. Cl.
*H04R 1/40* (2006.01)

(52) U.S. Cl. ..... 381/97; 381/99; 381/300

(58) Field of Classification Search ..... 381/300, 381/303, 307–308, 61–62, 97–102, 1, 17–18, 381/306, 92

See application file for complete search history.

(56) References Cited

U.S. PATENT DOCUMENTS 4,039,755 A 8/1977 Berkovitz
5,005,201 A 4/1991 Rumreich et al.
5,301,237 A 4/1994 Fosgate
5,598,480 A 1/1997 Kim
5,680,464 A 10/1997 Iwamatsu
5,809,150 A 9/1998 Eberbach
5,870,484 A 2/1999 Greenberger
6,057,659 A * 5/2000 Akiyama et al. ..... 381/98
6,373,955 B1 4/2002 Hooley
6,498,852 B2 * 12/2002 Grimani ..... 381/18
6,665,409 B1 12/2003 Rao
6,778,672 B2 8/2004 Breed (Continued)

OTHER PUBLICATIONS

Murray, John, "Understanding Line Array Systems", Live Sound International, prosoundweb.com, 2006.

(Continued)

*Primary Examiner*—Vivian Chin
*Assistant Examiner*—Disler Paul
(74) *Attorney, Agent, or Firm*—Andrew M. Harris; Mitch Harris, Atty at Law, LLC

(57) ABSTRACT

A method and system for surround sound beam-forming using vertically displaced drivers provides a low cost alternative to present external surround array systems. A pair of vertically displaced speaker drivers is supplied with surround and main channel information in a controlled phase relationship with respect to each driver such that the surround channel information is propagated in a directivity pattern substantially differing from that of the main channel information. The main channel information is generally directed at a listening area, while the surround channel information is directed away from the listening area and is substantially attenuated in the direction of the listening area, so that the surround channel information is heard as a diffuse reflected field. An electronic network provides for control of the surround channel phase relationship and combining of main and surround signals for providing inputs to individual power amplifiers for each driver.

12 Claims, 8 Drawing Sheets

U.S. PATENT DOCUMENTS

| | | | | |
|---|---|---|---|---|
| 6,937,737 | B2 | 8/2005 | Polk | |
| 7,123,731 | B2 | 10/2006 | Cohen et al. | |
| 7,382,885 | B1 * | 6/2008 | Kim et al. | 381/17 |
| 2001/0038702 | A1 * | 11/2001 | Lavoie et al. | 381/307 |
| 2004/0013271 | A1 | 1/2004 | Moorthy | |
| 2004/0151325 | A1 | 8/2004 | Hooley et al. | |
| 2004/0196405 | A1 | 10/2004 | Spinelli | |
| 2005/0041530 | A1 | 2/2005 | Goudie et al. | |
| 2005/0175194 | A1 | 8/2005 | Anderson | |
| 2005/0177256 | A1 | 8/2005 | Shintani et al. | |
| 2005/0226425 | A1 | 10/2005 | Polk | |
| 2006/0049889 | A1 | 3/2006 | Hooley | |
| 2007/0183608 | A1 * | 8/2007 | Willems | 381/307 |

OTHER PUBLICATIONS

Polk, Matthew S. "SDA Surround Technology White Paper", Polk Audio.

Product Brochure, Yamaha YSP-1 Digital Sound Projector.

Product Brochure, Yamaha YSP-1000 Digital Sound Projector.

* cited by examiner

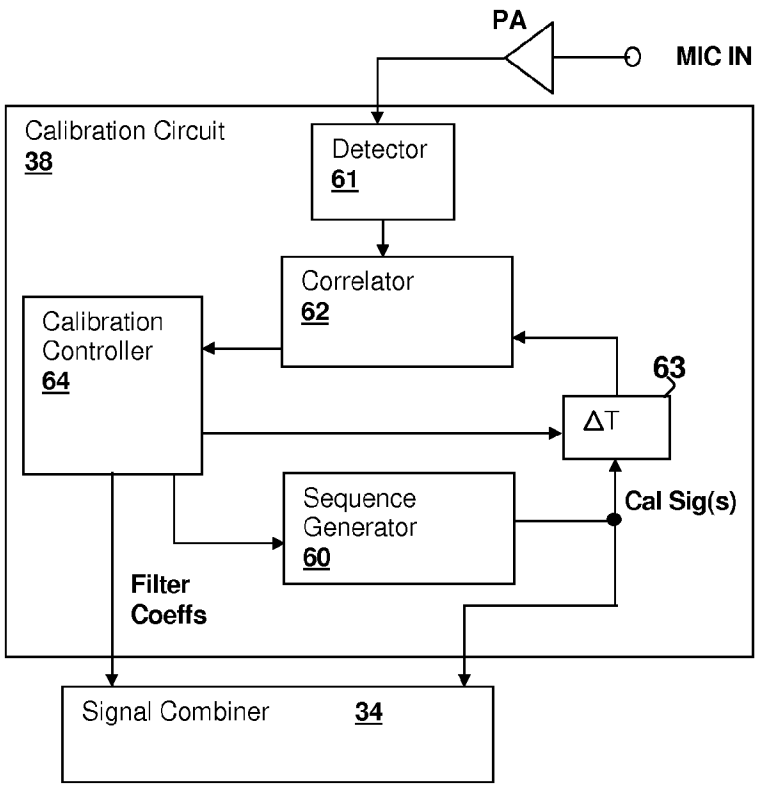
Fig. 7A
Fig. 7B
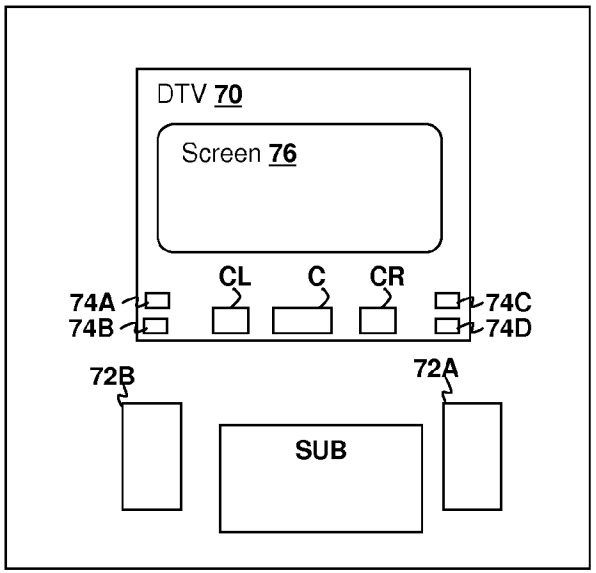
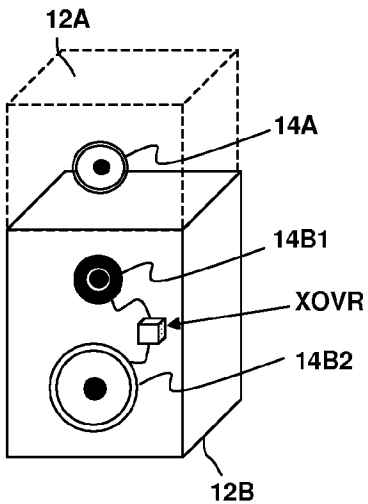
Fig. 7C

METHOD AND SYSTEM FOR SURROUND SOUND BEAM-FORMING USING VERTICALLY DISPLACED DRIVERS

CROSS-REFERENCE TO RELATED PATENT APPLICATIONS

The present application is a Continuation-in-Part of U.S. patent application Ser. No. 11/383,125, filed on May 12, 2006 now U.S. Pat. No. 7,545,946 by the same Inventor and assigned to the same Assignee. The specification of the above-referenced U.S. Patent Application and its parent U.S. patent application Ser. No. 11/380,840 are incorporated herein by reference.

BACKGROUND OF THE INVENTION

1. Field of the Invention

The present invention relates generally to home entertainment devices, and more specifically, to techniques for sound beam-forming using vertically displaced drivers.

2. Background of the Invention

Audio systems in home entertainment systems have evolved along with theatre audio systems to include multi-speaker surround sound capabilities. Only recently have discrete surround signals been available from sources in home entertainment systems and further only recently have encoded sources reached a sufficient level of home use for consumers to justify installation of the requisite equipment. With the development of Digital Versatile Disc (DVD) technology that provides surround audio source information for movies or surround-encoded music, and sophisticated computer games that provide surround audio, surround speaker installation in home environments has become more desirable and common. With the recent availability of digital television (DTV) signals, which can include surround audio signals as part of their audio-visual (A/V) information, increasing sales of televisions and/or DTV sets including surround channel outputs are expected. The surround signals may be encoded in a pair of stereo signals, such as early DBX or as in more recent Dolby or THX surround encoding, or may constitute a fully separate audio channel for each speaker, often referred to as discrete encoding.

In most consumer surround audio systems, an amplifier unit, which may be included in an AV receiver or in a television, provides signals to multiple sets of speakers, commonly in what is referred to as a 5.1, 6.1 or 7.1 arrangement. The 5.1 arrangement includes right, center and left main speakers located in the front of the room, and a right-left pair of surround speakers located in the rear of the room for providing an aural environment in which sounds can be psychoacoustically located such that they emanate from any horizontal direction. The "0.1" suffix indicates that an additional subwoofer is provided for providing low frequency sounds that are typically not sensed as emanating from a particular direction. The 6.1 configuration adds a center channel speaker in the surround speaker set and in a 7.1 configuration, an additional pair of speakers is included over the 5.1 configuration and located even farther back in the room from the surround channel speakers.

However, proper installation of surround channel speakers can be costly and undesirable in many home environments. Wiring must be added, and locations with unobstructed paths to the listening area must be available. Since the surround channel audio sources are generated for a particular location of the speakers, they cannot be simply placed at any location in the room and still function properly. It is desirable to position the surround speakers in such a way that the surround sound is diffuse, often limiting possible locations for speaker placement. The term "diffuse" indicates that the sound does not appear to emanate from a single direction, which is generally provided via reflections from one or more surfaces that cause the sound to be reflected toward the user from multiple angles.

There are essentially two types of surround sound implementations for handling the additional surround channel information: simulated surround and actual surround. In actual surround sound implementations, surround channel signals are provided to speakers placed behind the listener. In simulated surround implementations, the surround channel signal is provided to speakers placed in front of the listener.

Simulated surround sound implementations typically use filtering and/or delays to alter mono or stereo audio signals to provide outputs for additional front speakers to generate the surround field. U.S. Pat. No. 6,937,737 describes a simulated surround sound system that provides the right and left surround channel information to each side (right and left) of an additional stereo speaker pair as well as to each side of the main stereo speaker pair. The frequency response of the system is controlled to cause the apparent position of the surround channel information to appear wider than the speaker position. However, such systems do not provide surround sound performance approaching that of actual surround sound implementations.

Therefore, beam-forming systems have been developed that provide surround sound fields from encoded or discrete sources that are not only widening systems, but form beams that can direct the sound toward walls and away from the listener, thus providing the surround channel information as reflections. Such systems typically use a large horizontally distributed array of speakers in order to form separate beams for the surround channel sources that direct the surround channel sound away from the listener toward the walls so that the surround channel sounds arrive later and from a different angle. However, such arrays are costly, as separate drivers must be provided for each element in the array. Further, tuning of such an array system can be complicated by the lack of unobstructed paths to the reflection zones at the walls of the room. U.S. published Patent Application 20040151325A1 describes such a large horizontal array beam-forming system, and U.S. published Patent Application 20050041530A1 describes a two-dimensional array system that provides a beam focused in both horizontal and vertical planes.

Most full-range speaker systems used in high fidelity stereo and main channel installations include multiple drivers, such as two-way (woofer/tweeter) or three-way (woofer/midrange/tweeter) speakers. However, the operation of each driver is typically assigned to a specific frequency band by a crossover network that filters the input audio signal to provide the proper signals for each driver. Such a network is also generally necessary to protect the high-frequency driver (tweeter) from damage due to low frequency content. Due to the discrete frequency range assignment, multi-driver speakers are not usually employed in the above-described array systems, and instead, a uniform set of drivers is employed in the same frequency range in order to provide beam-forming in the particular range of the set of drivers.

Therefore, it would be desirable to provide a beam-forming speaker system that can provide simulated surround sound without requiring an array with a large number of elements, and that further reduces the difficulty in providing an unobstructed path for the beam(s).

SUMMARY OF THE INVENTION

The above stated objective of providing a beam-forming speaker system without requiring an array with a large number of elements satisfied in a method and system. The method is a method of operation of the system or a device incorporating the elements of the system.

The system uses a set of at least two vertically displaced drivers. The drivers are used in substantially opposing polarity response with respect to a surround channel input, in order to generate one or more beams directed away from a listening position, so that the surround channel is heard substantially only as reflections. The beam is generally directed above the listener, but may be directed above and to the right or left, depending on the rotational orientation of the drivers' primary axes with respect to each other. The response to main channel information is provided to the drivers with a phase-alignment that provides a wide main lobe directed at the listening position.

An electronic network receives the main and surround channel information and combines them to produce the signals provided to the drivers. The network is an active circuit providing an input to individual speaker power stages, and may be included within a speaker cabinet.

Alternatively, the network may be provided as part of a device such as a receiver or television that has separate outputs for each driver in external driver pairs. Also alternatively, the drivers may be included within a device such as a television or portable stereo, along with the electronic network, providing a compact surround beam-forming solution. Each side of a stereo speaker set may be provided with such a set of beam-forming drivers so that two main and two surround beams are provided by the system. Additional speakers or sets of beam-forming speakers can be added to the system to increase the quality of the sound reproduction.

In other embodiments of the invention, one of the drivers can be located on the top or the side of a speaker or device cabinet, with the other driver located on the front facing the listening area. The above-described network can be used with such a configuration, or alternatively a simplified network that supplies the main channel information in the beam-forming midrange frequency band only to the front channel. The network then adjusts the amplitude of the surround signal supplied to the front-facing driver (in opposite polarity with respect to the upward or side facing driver) to produce a null toward the listening position. The speaker cabinet may be made in portions with a rotating linkage or interlocking feet/recesses in order to provide for changing configurations between two front-facing drivers, or one of the alternative orientations mentioned above.

Details of the invention and the uses thereof will be understood by a person of skill in the art when reading the following description in conjunction with the drawings. Further objectives and advantages of the invention will be apparent in light of the following description and drawings, wherein like reference numerals indicate like components.

BRIEF DESCRIPTION OF THE DRAWINGS

FIG. 7A is an illustration depicting a DTV in accordance with an embodiment of the present invention.

FIG. 7B is a block diagram of a calibration sub-system in accordance with an embodiment of the present invention and FIG. 7C is a block diagram of a speaker system in accordance with an embodiment of the present invention.

DESCRIPTION OF ILLUSTRATIVE EMBODIMENT

Figure 1:
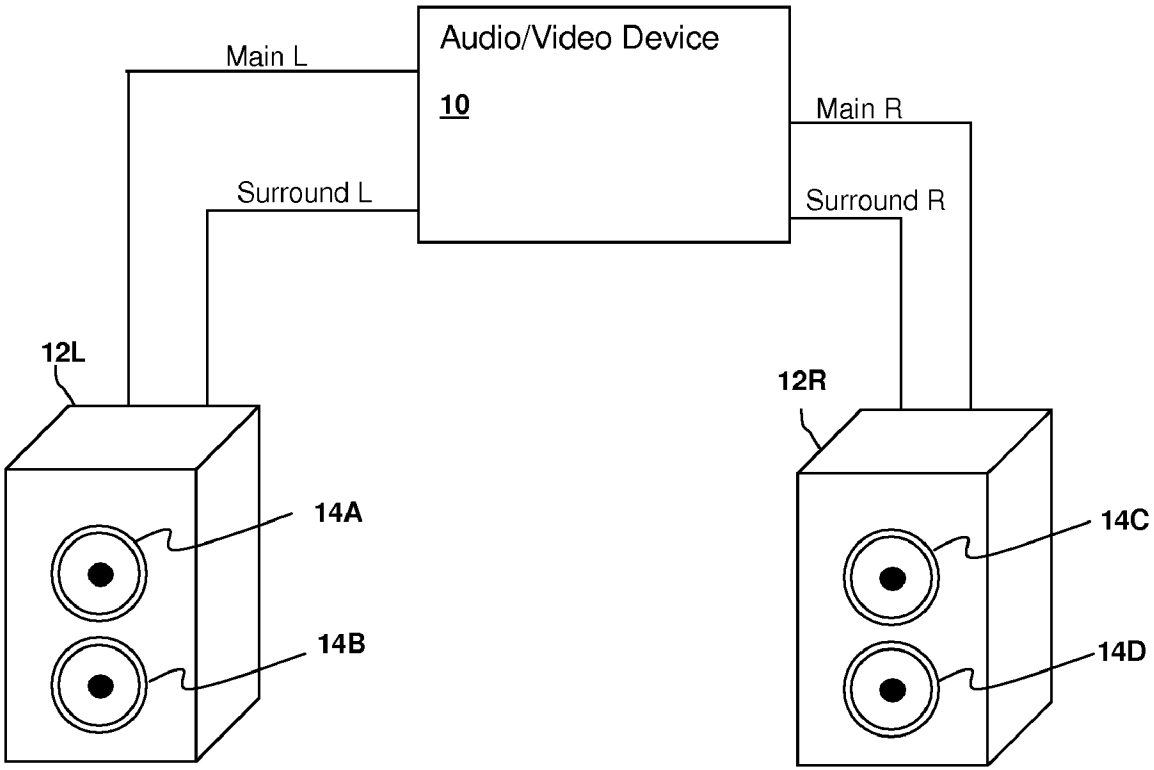
FIG. 1 is a pictorial diagram of a system in accordance with an embodiment of the present invention.

The present invention encompasses systems and methods that include a pair of speaker drivers in a surround sound beam-forming process. The speaker drivers generally have substantially similar frequency ranges, e.g., full range speakers, but the techniques of the present invention may also be applied to speaker driver pairs having some level of non-overlap in their responses, for example a woofer-midrange paired with a full-range speaker can be used to implement a system in accordance with the present invention.

In the present invention, main channel content is provided to a full-range first driver over the full audio range, so that the main channel information is propagated toward a listening area. Main channel midrange information is provided to the second driver, and main channel low frequency information is also optionally provided to the second driver, if the second driver has a sufficient low-frequency response. The main channel information is provided in substantially the same polarity to the first and second drivers, so that a wide main directivity pattern is provided on-axis to a listening area. In the present invention, surround channel information is provided in a controlled-phase relationship in the midrange that differs from that of the response of the drivers to the main channel information. The differing controlled-phase relationship forms a second directivity pattern that is directed away from the listening area, i.e., is substantially attenuated on a direct path toward the listening area, so that most of the surround channel information is reflected at least once before reaching the listening area. The surround channel information and main channel information are thereby superimposed on the listening environment in differing directions by two speaker drivers by virtue of a phase relationship between each driver that differs with respect to the main and surround channel signals in the overlap region. The main channel high-frequency information is generally excluded from the second driver, to avoid "combing " or formation of multiple lobes in the high-frequency directivity of the main channel. The high-frequency surround channel is generally summed for right and left channels, reverberated with differing delays and supplied to one or both speaker drivers on each side of a stereo set of speaker driver pairs.

By directing the midrange surround channel information away from the listening area and reverberating the high-frequency surround information, the surround content is heard only as diffuse reflections, providing the ability to simulate a surround sound listening environment from speakers positioned only at one end of a room. However, the speakers may be located at other positions in the room, with the surround channel directivity pattern increasing the diffusion by directing the surround channel information away from the listener. For example, the techniques of the present invention may be implemented in rear speakers of a 5.1 speaker configuration to provide a simulated 7.1 surround sound implementation. The in-phase inputs (main channel inputs) of the speakers of the present invention can be connected to the side channel outputs of a receiver or other 7.1 surround sounds device and the controlled-phase inputs (surround channel inputs) of the speakers are connected to the back channel outputs of the receiver, providing an acoustic environment that is experienced as larger than the actual room size.

The system may be incorporated within an audio/video device having speakers included for the rendering of audio content, such as a DTV or computer monitor, or may be an audio-only device, such as a stereo system having internal speakers. The system may also be incorporated in stand-alone speaker systems that include an internal electronic network that provides outputs to the speaker drivers to form a beam for direction of the surround channel information, or separate high and low frequency driver power outputs can be provided from another unit incorporating the electronic beam-forming network.

Referring now to the Figures, and in particular to FIG. 1, a system in accordance with an embodiment of the present invention is illustrated. The illustrated system is an audio/video (AV) device 10 connected to an external stereo set of speakers 12L and 12R, each having a corresponding surround and main channel input coupled to AV device 10. Each speaker 12L,12R includes at least two drivers 14A,14B and 14C,14D, respectively. In the exemplary system of FIG. 1, drivers 14A-D are all full-range drivers. However, the illustrated system is only exemplary and as mentioned above, the invention can be practiced with drivers having differing frequency ranges.

Each of speakers 12L,12R includes an internal electronic network (not shown) that combines the main and surround channel signals received by each speaker in order to form two differing "beams " or differing directivity patterns. The first beam, which carries the main channel information, is generally the same as for an ordinary speaker, that is, driver pairs 14A,14B and 14C,14D are phase-aligned to reproduce the main channel information at a listening area directly in front of speakers 12L,12R. However, in the mid-range of frequencies, driver pairs 14A,14B and 14C,14D are provided with surround channel information in a controlled phase/frequency relationship as between the drivers in each driver pair, so that a second directivity pattern directed away from the listening area is produced for the surround channel information. The result is that the surround channel information is directed toward the walls, floor and/or ceiling of the room so that arrival of the surround channel information at the listening area is heard only as diffuse reflections.

Figure 2:
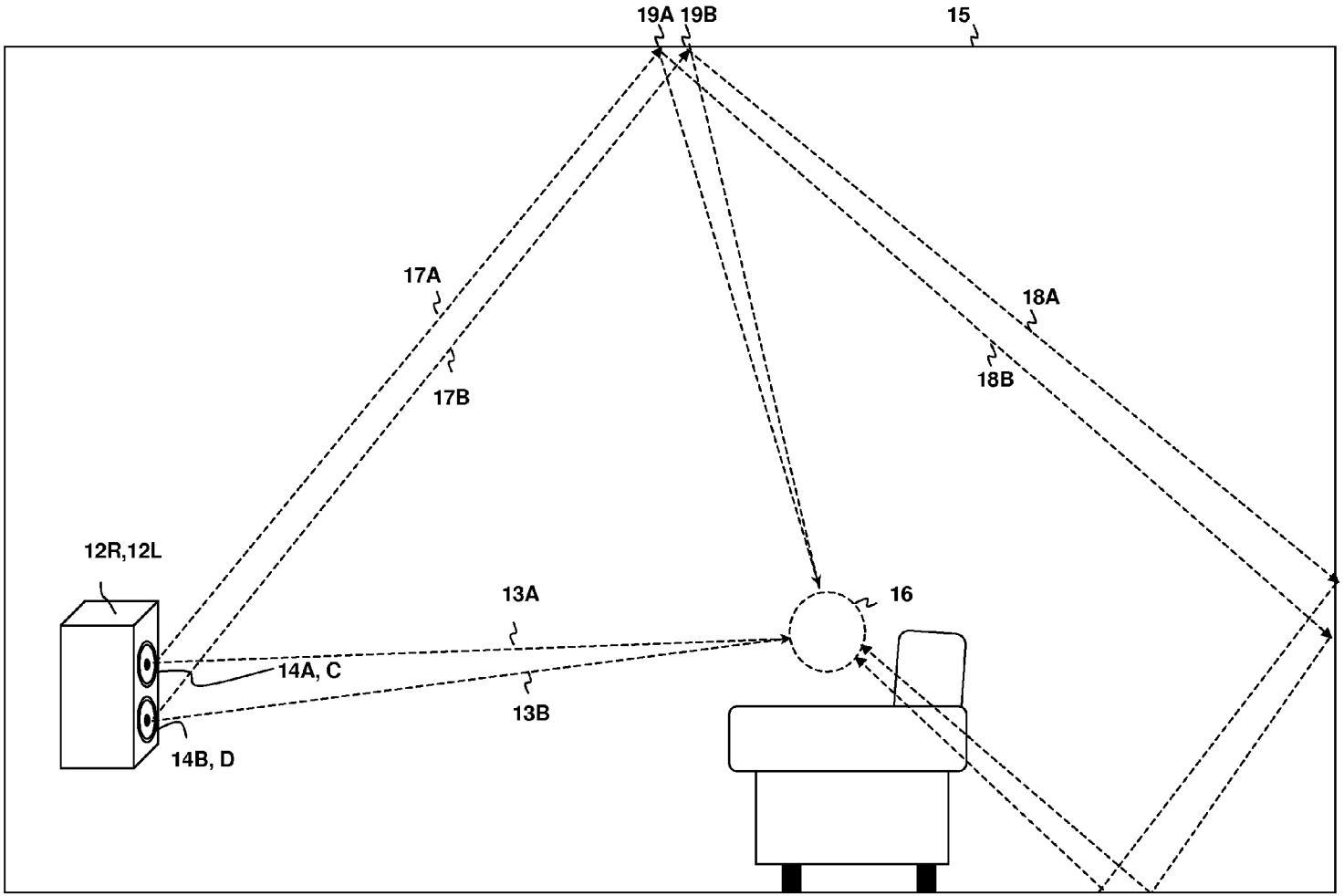
FIG. 2 is a side view of a listening environment including a system in accordance with an embodiment of the present invention.

Referring now to FIG. 2, a side view of a listening environment including the system of FIG. 1 is depicted. The main channel information reproduced through speakers 12L,12R propagates along a direct path 13A,B providing the first arrival of main channel sounds at a listening area 16. The surround channel mid-range information is provided to both drivers 14A,B and 14C,D of each speaker 12L,12R and is phase-aligned in a substantially out-of-phase relationship as between drivers 14A,C and other driver 14B,D so that a null is produced along direct path 13A,B. Due to the spacings between drivers 14A,C and drivers 14B,D, and the phase vs. frequency relationship maintained between drivers 14A,C and drivers 14B,D, the surround channel information is propagated along path 17A, 17B. The surround channel information is reflected at point 19A, 19B of ceiling 15 and is reflected toward listening area 16 and/or along paths 18A, 18B, which cause the surround channel information to arrive much later at listening position 16 and to be heard as diffuse (non-directional).

The illustrated forward-facing on-axis alignment of the speakers is not a limitation of the present invention, as in some embodiments of the invention disclosed herein below, other orientations of at least one of the drivers in each speaker 12R, 12L will be illustrated. Such orientations are also not limited to reflecting surround channel information only from ceiling 15, as other orientations of a driver will cause the surround channel information to be diffused by reflections from the walls of the room or in combination with reflections from ceiling 15.

The surround beam-forming implemented in the system of the present invention uses a fairly wide band of midrange frequencies that, in general, is limited only at the low-frequency end of the band by the spacing between drivers 14A,B and 14C,D. At low frequencies, the spacing becomes so small with respect to a wavelength of sound in air, that the surround channel directivity pattern cannot form a null in any direction. Further, the usable high-frequency overlap range is further limited by the spacing between drivers 14A and 14B (and similarly drivers 14C and 14D) due to "combing " or degeneration of the surround channel beam into multiple beams, when the wavelength becomes short with respect to the driver spacing.

In general, the practical surround-channel beam-forming frequency ranges will extend from approximately 200Hz to 2500Hz, due to the spacing between the drivers. However, the practical overlap range can be "learned" during the calibration process described below and the surround channel frequency range adjusted in conformity with the calibration measurement results.

Figure 3:
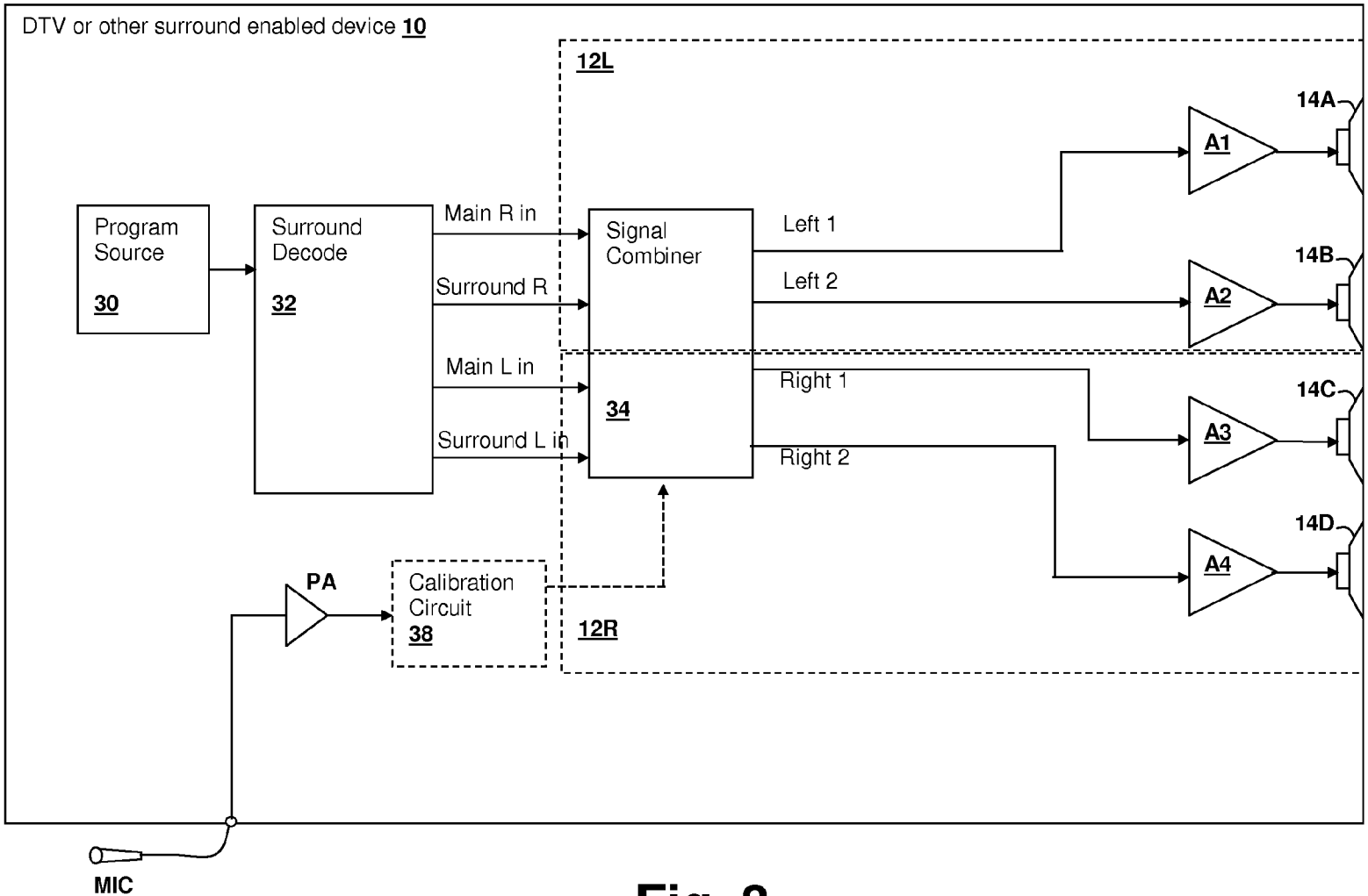
FIG. 3 is a block diagram of the system depicted in FIGS. 1-2.

Referring now to FIG. 3, a block diagram of circuits within the system of FIG. 1 is shown. A DTV or another surround-enabled device 10 includes a program source 30, which may also be provided or selected from an external connection, that supplies a surround decode circuit 32 with program information. Surround decode circuit 32 provides main channel and surround channel outputs to a signal combiner network 34. In applications in which program source 30 does not contain surround channel information, surround decode circuit 32 can include a surround synthesizer circuit for generating simulated surround information from a stereo program.

Signal combiner network 34 combines the surround channel information and main channel information to provide signals to the inputs of amplifiers A1-A4 such that the surround channel information is directed away from the listening position, while the main channel information is presented directly toward the listening position. The outputs of amplifiers A1-A4 are provided to speaker drivers 14A-14D, which can be included within the cabinet of device 10 or optionally located in external speakers 12L and 12R. If amplifiers A1-A4 are located in external speakers 12L and 12R along with signal combiner network 34, then signal combiner network 34 is divided across two circuits, one in each speaker cabinet. Additionally, if surround decode circuit 32 provides synthesized surround sound, the synthesizer circuits can be incorporated within external speakers 12R and 12L providing speakers that can synthesize a surround image from just a main channel signal.

If amplifiers A1-A4 are included within device 10, signal combiner network 34 may be made reconfigurable, so that use with traditional main and surround channel speakers can be selected for one "standard " operating mode, with the main and surround channel information amplified and supplied to external speaker connections. Then in another operating mode in accordance with an embodiment of the present invention, the external speaker connections are supplied as connections to driver pairs as described above. In particular, an audio/video receiver (AVR) can be provided that in standard operating mode will perform as a standard AVR with power outputs and in a second operating mode provide power outputs for operation with a 2-way speaker system having separate terminals for each driver. Also, if the AVR has line outputs instead of power outputs, special external powered speaker cabinets may be provided that have separate line inputs for connection to each of amplifiers A1-A4, which are then provided within the external speaker cabinets.

An optional calibration circuit 38 may be included and connected to a microphone MIC input via a preamplifier PA. Microphone MIC is ideally an omni-directional microphone, so that all responses with respect to a given speaker or combination of speakers is detected during calibration. When all of the electronics and drivers are included within device 10, it is advantageous to provide calibration circuit 38 and tunable filters within signal combiner network 34 so that the directivity patterns associated with the main and surround channel information can be optimized to a particular room and installation.

However, calibration is not required to practice the present invention and in particular, if drivers 14A,B and 14C,D are located in corresponding separate external speaker cabinets 12L and 12R, the electronic network may be a pre-tuned or manually tunable digital or analog circuit that performs the phase alignment between the drivers. If pre-tuned external speakers having forward-facing drivers are employed, the tuning is generally 180 degrees out of phase for the surround channel overlap frequency range, in-phase for the main channel and low-frequency surround, and high-frequency surround is sent only to one of the drivers. The phase-alignment will differ from the above for driver pairs in which one of the drivers is mounted on another face of the cabinet and will be made so that the drivers form a lobe toward the listening area for main channel information and a null toward the listening area for surround channel information.

Figure 4B:
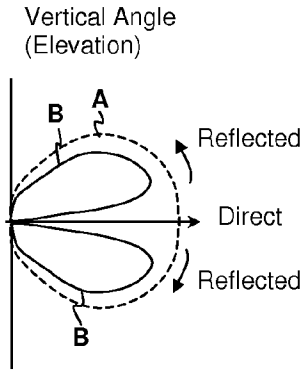
FIG. 4B is a graph showing sound pressure level directivity patterns produced by the speaker arrangement of FIG. 4A.
Figure 4A:
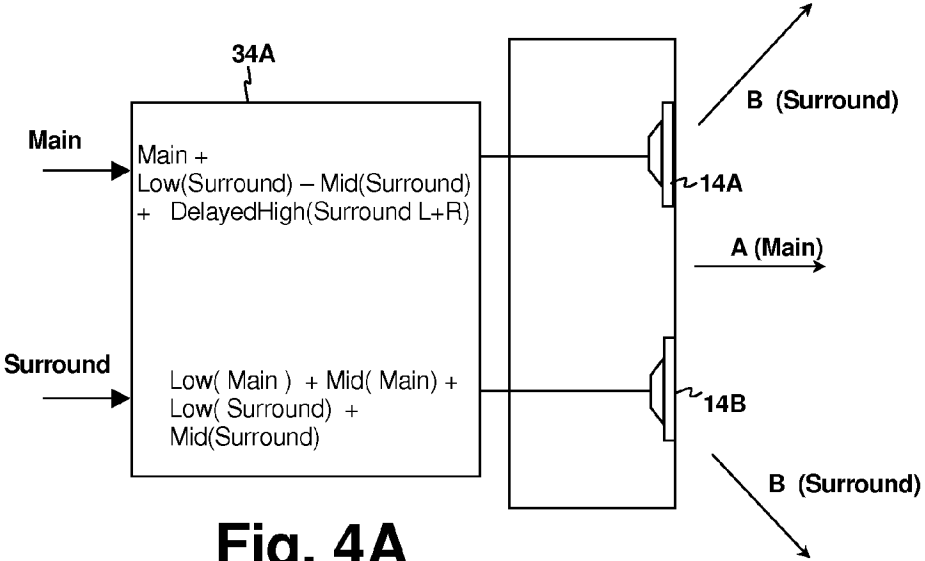
FIG. 4A is an illustration showing a speaker arrangement that can be employed in the system of FIGS. 1 and 2.

Referring now to FIG. 4A, an illustration showing a speaker arrangement that may be employed in the system of FIGS. 1-3 is depicted in accordance with an embodiment of the present invention. In the depicted embodiment, drivers 14A and 14B are both used in the midrange and low frequency ranges, but only driver 14A is used in the high frequency ranges to prevent combing effects due to the spacing between drivers 14A and 14B. Drivers 14A and 14B may have identical frequency ranges or driver 14B may be more suited for lower-frequency (mid and bass) reproduction. Additionally, driver 14A may have limited bass response and may be provided with only the mid and high frequency components of the surround and main channel signals. However, the present invention differs from that of the woofer and tweeter overlap operation disclosed in the above-incorporated parent U.S. Patent Application, as the drivers are generally used in frequency bands not substantially exceeding their corresponding design frequency ranges and there is no requirement that there be a difference in the driver frequency responses at all.

A simplified combiner 34A is shown for illustrative purposes that receives a Main channel signal and a Surround channel signal. The signal provided to driver 14A combines the full frequency range of the main signal, the low frequency portion of the surround channel signal, a phase-inverted version of the middle frequency range of the surround channel signal, and a delayed high-frequency portion of the surround channel signal combined from both right and left surround channels. The delayed high-frequency portion of the surround channel signal is provided so that any high-frequency content of the surround channel is not lost and is generally formed by summing the high-frequency portions of the surround channel signals from right and left after delaying them by different time delays. The result is a more diffuse (non-directional) presentation of the surround channel high-frequency information. There is no need to combine the right and left channel low-frequency information, as that information is generally non-directional. The signal provided to driver 14B combines the low-frequency and midrange frequency portions of both the main and surround channel signals.

The result of the operation of combiner 34A is that combiner 34A provides the Main channel signals to both drivers 14A and 14B, but removes the high frequency portion of the signal supplied to driver 14B (for both main and surround channel information) to prevent combing. The low frequency portion of the Surround channel signal is provided in the same polarity to both drivers 14A and 14B in order to provide improved bass performance, assuming both drivers 14A and 14B have suitable low frequency response. The midrange frequency portion of the Surround channel signal is provided in opposite polarity to both drivers 14A and 14B in order to form the surround channel directivity pattern that directs the midrange portion of the surround channel information away from the listening position. Finally, the high frequency portion of the surround channel signal is reverberated as described above and applied to driver 14A.

Thus, the overlap frequency range portion of the Surround channel signal is provided out-of-phase (as between drivers 14A and 14B in the overlapping frequency range) along the direct path to a listener located on-axis between drivers 14A and 14B, (e.g. directly in front of speaker 12L), producing a null with respect to the surround channel information toward the listener. The listener will not hear the surround channel information as emanating from speaker 12L, but will hear the surround channel information as diffuse, coming from a range of reflection points primarily along the ceiling and/or the rear of the room. The main channel information is provided in-phase as between drivers 14A and 14B along the direct path, so that the main channel information is heard as emanating from the speakers.

Referring now to FIG. 4B, a directivity pattern is shown for the vertical orientation of the drivers of the present invention as shown in the speaker arrangement of FIG. 4A. Directivity pattern A is shown as having a substantially cardioid shape and carries the main channel information, low frequency surround information and the diffused high frequency surround information. Directivity pattern B has two lobes, one directed at the ceiling and one directed at the floor, due to the displacement of drivers 14A and 14B and the out-of-phase alignment of the surround channel information in the overlap frequency range. Directivity pattern B carries the midrange frequency component of the surround channel information.

Figure 4C:
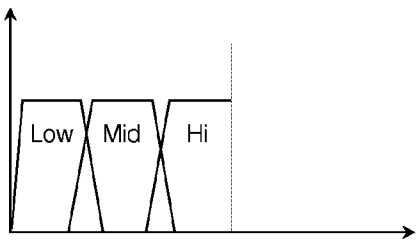
FIG. 4C is a graph illustrating frequency bands as may be allocated between drivers in the system of FIGS. 1-2.

FIG. 4C illustrates the three band filtering scheme of combiner 34A in which beam-forming is employed in the midrange frequency band Mid. In the Low frequency band, the sum of the main and surround channel information can be sent to both speakers, since the longer wavelengths will ensure that the drivers act in phase. Alternatively, the Low band might be provided only to one driver having superior bass response such as external speakers for a digital television, or such decision may be performed selectively, in response to the results of a calibration or user setting, or as a fixed design feature under the assumption that external speakers will have superior low frequency response. In the High frequency band, generally only one of the speakers will be used so that "combing" effects do not occur due to interference between the speakers.

Figure 5A:
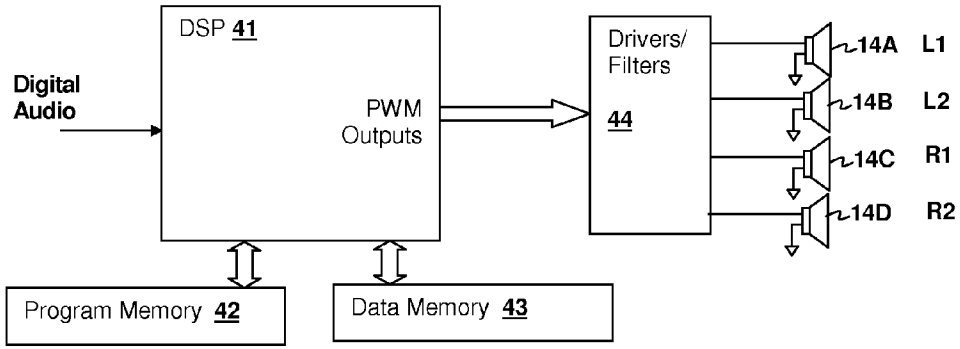
FIG. 5A is a block diagram of a system in accordance with another embodiment of the present invention.

Referring now to FIG. 5A, a system in accordance with an embodiment of the present invention is shown. The depicted system employs a digital signal processor (DSP) 41 that performs the signal combining/filtering operations, as well as frequency-band splitting and any compression/protection algorithms used in the system. DSP 41 is coupled to a program memory 42 containing program instructions forming a computer program product in accordance with an embodiment of the present invention, and further coupled to a data memory 43 for storing data used by the computer program and results produced thereby. The outputs of DSP 41 are depicted as pulse-width modulator (PWM) outputs for each channel, with corresponding low-pass filters and driver transistors 44, generally half-bridge circuits with series LC filters connected to drivers 14A-14D. The signal combining, filtering and compression operations performed by the algorithms of the computer program embodiment will be described in further detail below in illustrations that apply to discrete circuits as well as the algorithms executed by DSP 41.

Figure 5B:
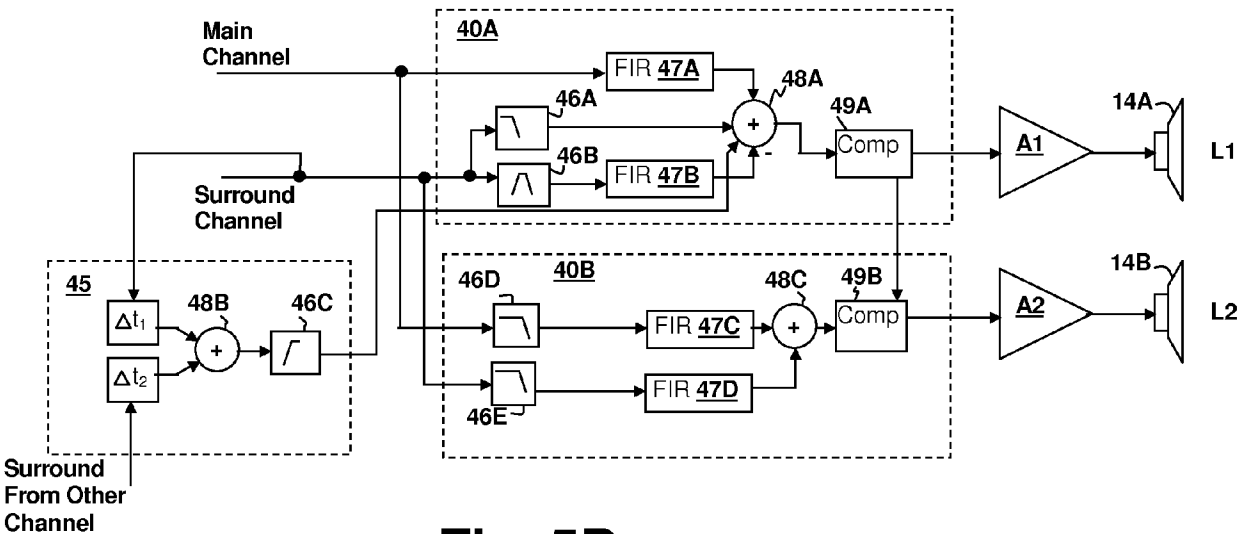
FIG. 5B is a block diagram of a system in accordance with yet another embodiment of the present invention.

Referring now to FIG. 5B, a direct and surround channel circuit or algorithm in accordance with an embodiment of the present invention is shown in a block diagram. Only one stereo side (right or left) of the system is shown with respect to a first driver processing block 40A and second driver processing block 40B, as the other side will generally be an identical circuit. However a common high-frequency surround channel diffusion block 45 is shown that includes differing delays $\Delta t_1$, $\Delta t_2$, and a summer 48B to combine the delayed right and left surround channel signals and a high-pass filter 46C to provide the diffused high-frequency surround information to a combiner 48A within high-frequency processing block 40A that supplies the signal provided to driver 14A through amplifier Al and compressor 49A.

Processing block 40A includes a low frequency filter 46A for the surround channel which provides a surround channel low-frequency input to combiner 48A and a bandpass midrange filter 46B for providing the midrange beam-forming portion of the surround channel signal, which is provided in negative polarity to combiner 48A. Optional finite impulse response (FIR) filters 47A and 47B provide for adjustment of main channel and surround channel phase vs. frequency response for calibrating the system. Compressor 49A acts to limit excessive levels provided to driver 14A generated by the beam-forming operations that might damage driver 14A or clip amplifier Al. Compressor 49A can be alternatively located between FIR filter 47B and combiner 48A in order to compress only the surround channel information within the signal provided to driver 14A.

Processing block 40B provides the signal to driver 14B through amplifier A2 and includes a low-pass filter 46D for the main channel and a similar low-pass filter 46E for the surround channel. Filters 46D and 46E provide the low and midrange frequency components of the main and surround channel signals, respectively to a combiner 48C that combines the outputs of filters 46D and 46E. Optional FIR filters 47C and 47D provide for adjustment of main channel and surround channel phase vs. frequency response for calibrating the system. An optional compressor 49B acts to prevent amplifier clipping or speaker damage when the increased gain of either filter 46E or FIR filter 47D raises the gain of processing block 40B with respect to the surround channel information in order to beam-form. Also, if compressor 49B receives control signals from compressor 49A, the match in level between the signals provided to drivers 14A and 14B can be maintained for beam-forming while compressor 49A is acting to protect driver 14A and/or prevent clipping in amplifier A1.

While the illustrative structure of processing blocks 40A and 40B show identical polarity for the main channel information and opposing polarity for the mid-range of the surround channel, depending on speaker orientation as described below and room configuration and other factors, the polarity may be viewed as exemplary for an ideal pair of drivers 14A, 14B in an ideal environment. Systems such as that of FIG. 5A are not restricted as to structure, and the operations of processing blocks 40A and 40B can be entirely incorporated within algorithms implemented by program instructions executed by DSP 41. Further the operations of the various frequency band filters can be absorbed within individual FIR filters that couple the surround and main channel information to the driver output channels, and the "polarity " can be any phase/frequency relationship of any input channel as coupled to any output channel that is required to accomplish the stated goal of directing midrange surround channel information away from the listening position while maintaining a main channel directive listening environment. The primary consideration is that the response of the main channel over frequency in the crossover region is uniform on-axis, while the response of the surround channel information produces a directivity pattern that is directed away from the on-axis listening position, at least in the middle range of frequencies.

The channel circuit of FIG. 5B is an example of an arrangement of blocks that implement an embodiment of the present invention or cascaded operations that can be applied in a DSP algorithm. However, alternative implementations are possible and in some instances preferred. For example, all of the filtering operations could be performed within FIR filter blocks, with the in-phase/out-of-phase midrange beam-forming summations performed also within the FIR filter blocks. Likewise, speaker protection/clipping-prevention compression can be made part of the filter algorithm, as well. Therefore, a more generic expression of a channel circuit in accordance with an embodiment of the present invention can be made as a set of FIR filters each receiving either a Main or Surround channel signal and having output summed for forming the input signals to amplifiers A1 and A2. Additional FIR filters for each discrete other speaker may be provided (e.g., center speaker or additional horizontally distributed speakers).

Alternatively, the main channel can be provided without any FIR filter adjustment, the surround channel provided to one of the drivers without FIR filter adjustment and a single FIR filter 47B or 47D can be used to calibrate or otherwise tune only the relationship between the mid-range surround channel information provided to drivers 14A and 14B. The calibration can then be performed so that the on-axis surround channel null can be optimized and/or the position of the lobes in the surround channel beam directed to maximize the diffusion of the sound.

Figure 6A:
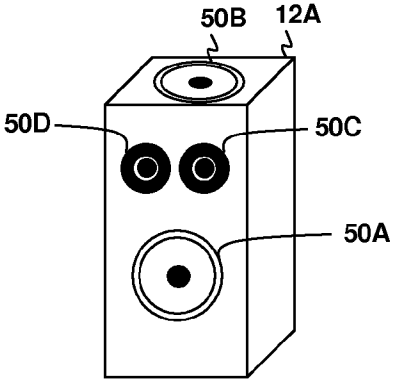
FIGS. 6A-6E are pictorial diagrams depicting speaker configurations in accordance with various embodiments of the present invention.

Referring now to FIGS. 6A-6E, a variety of possible alternative speaker configurations is disclosed in accordance with other embodiments of the invention. FIG. 6A shows a configuration with a top-mounted midrange-woofer driver 50B, a pair of front-mounted tweeters 50C and 50D along with a front-mounted midrange-woofer 50A. Such a configuration can extend the low-frequency beam-forming limit by increasing the effective distance between drivers 50A and 50B used for beam-forming at low frequencies. The amount of surround channel information supplied to driver 50B will generally be larger relative to the amount supplied to driver 50A in order to direct the beam toward the ceiling and produce a null toward the listener. Driver 50A will generally only need to supply sufficient surround information to cancel the sound diffracted around the edge of cabinet 12A from driver 50B and possibly some directly propagated level depending on the elevation of driver 50B with respect to the listening position. Tweeters 50C and 50D may have responses in the upper midrange and may also be used for beam-forming to direct surround channel information away from the listening position, or may be used as parallel tweeter drivers.

Figure 6B:
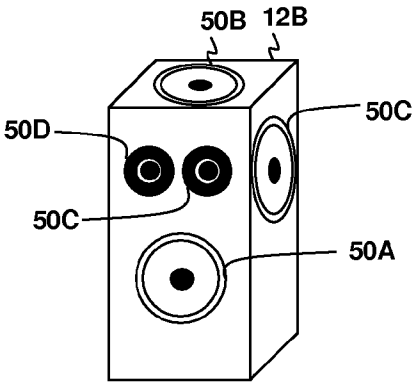
Figure 6C:
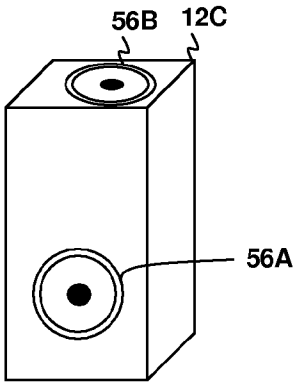

FIG. 6B shows another alternative speaker configuration with an additional driver 50C mounted on the side of cabinet 12B. Operation and calibration is similar to that of the speaker of FIG. 6A, with the primary pattern of driver 50C directed toward side walls of the room, further tuning is possible to direct surround channel sound away from the listening position. FIG. 6C illustrates another speaker configuration similar to the speaker of FIG. 6A, with a full range driver 56A mounted in the face of cabinet 12C and another full range driver 56B mounted on top. Calibration is the same as that for the configuration of FIG. 6A, with the full range of frequencies being biased toward driver 56B for the surround channel and driver 56A for the main channel. The reverberated high-frequency surround channel signal will generally be supplied to driver 56B.

Figure 6D:
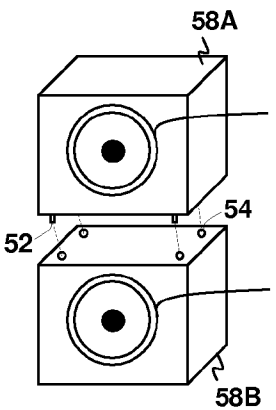

FIG. 6D shows another alternative speaker configuration with a cabinet portion 58A located above another cabinet portion 58B. Feet 52 on cabinet portion 58A align with recesses 54 provided in cabinet portion 58B so that cabinet portion can be rotated to point away from listening position in 90 degree rotations. Feet 52 may also be provided on the back of cabinet portion 58A so that driver 50B may be rotated to an upward-facing orientation.

Figure 6E:
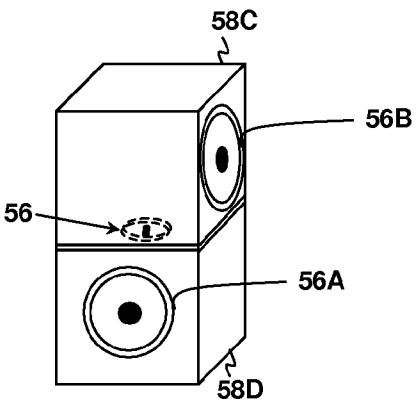

FIG. 6E shows yet another configurable speaker arrangement with a rotating swivel 56 attaching cabinet portion 58C with cabinet portion 58D. Such a system can have one speaker driver rotated to azimuthal angle with respect to the other speaker driver, in the depicted configuration, and can also be rotated in elevation if the entire speaker is rotated 90 degrees (e.g., laid on its side). Thus either the configuration of FIG. 6D or FIG. 6E can be employed to achieve the configurations of FIGS. 6A-6C (without the tweeters) and the configuration of FIG. 6E provides possible other rotations that may improve calibration of the system in particular environments.

Figure 6F:
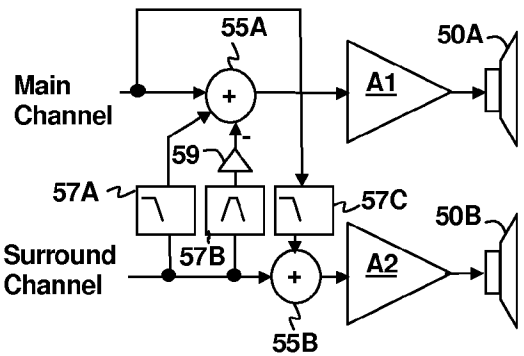
FIG. 6F is a block diagram of a system in accordance with another embodiment of the present invention.

FIG. 6F illustrates an alternative system in accordance with an embodiment of the present invention that provides a simplified implementation of a signal combiner for speaker configurations such as that of FIGS. 6A-6C. In the depicted embodiment, separate amplifiers A1 and A2 provide signals to drivers 50A and 50B, respectively. The main channel is applied to amplifier A1 through a combiner 55A, and the low frequency portion of the main channel signal provided through a low-pass filter 57C may also be optionally applied to the input of amplifier A2 by a combiner 55B. The low frequency portion of the surround channel signal provided through a low-pass filter 57A may be applied to combiner 55A with matching polarity to that of the main channel signal. The midrange beam-forming portion of the surround channel information provided through a band-pass filter 57B is combined with other signals in inverted polarity by combiner 55A and has an amplitude controlled by adjustable amplifier 59. Since the midrange portion of the main channel signal is supplied only to front-facing driver 50A, a wide directivity pattern directed at the listening area is ensured for the main channel information. The surround channel information is directed away from the listening position by driver 50B, and adjustable amplifier 59 provides for addition of a generally small amount of inverted polarity surround channel signal to driver 50A to provide for tuning a null in the surround channel directivity pattern toward the listening area.

FIG. 7A illustrates one possible implementation of a 5.1 or 7.1 DTV system 70 including a display screen 76 and an associated speaker arrangement. DTV 70 includes driver pairs 74A,B and 74C,D and may further include a center speaker C, along with a center left CL and center right CR speaker. A vertical beam-forming speaker array is provided as described above by internal driver pairs 74A,B and 74C,D and may also include external speakers 72A-B that may also have vertical or horizontal beam-forming woofer/tweeter arrangements. A subwoofer/effects channel speaker SUB is located beneath DTV 70. The resultant combination increases the degrees of freedom possible in calibrating maximum surround channel effect via adjustment of the individual FIR filters in the DTV 70 internal processing circuits.

Referring now to FIG. 7B, a calibration circuit 38 that may be employed in the system of FIG. 3 is illustrated in a block diagram. A calibration controller 64 in response to a user control of DTV 10 applies the output of a sequence generator 60 to signal combiner network 34. Either one channel can be calibrated at a time, or multiple uncorrelated sequences can be provided to all channels for simultaneous calibration. An adjustable delay 63 applies the sequence signal(s) to a correlator (or multiple correlators) 62 that correlate the sequence (s) with a microphone signal provided from detector 61. The arrangement permits calibration controller 64 to determine the impulse response of each channel at the microphone position. With the microphone placed at the desired listening position, the system can then be calibrated via the adjustment of the filter coefficients within signal combiner network 34. The system may be calibrated to minimize the reverberant (reflected) energy with respect to the main channel inputs and maximize the reverberation with respect to the surround channel inputs, by adjusting the phase response of each driver with respect to the main and surround channel inputs. While the illustrated calibration system uses a sequence such as a maximal-length sequence (MLS) to extract the impulse response of the system, frequency sweeping, chirping, or white/pink noise techniques may be similarly employed, with correlator 62 replaced with an appropriate filter.

Referring now to FIG. 7C, a particularly useful speaker configuration is shown that further illustrates the techniques of the present invention apply to driver sets or stand-alone speakers used in combination with other driver(s) for beam-forming. While the above-described embodiments generally disclose two speaker drivers having two different phase alignments, one for surround and one for main channel information, multiple driver sets having traditional crossover networks can be used as one or both of the beam-forming pair.

In FIG. 7C, a woofer 14B1 and tweeter 14B2 are connected via a crossover network XOVR that may be an active or passive crossover network. Woofer 14B1 and tweeter 14B2 are mounted in a cabinet 12B and another cabinet 12A is located atop cabinet 12B. A1ternatively, cabinet 12B may be a portion of cabinet 12A forming single unitized speaker. A full-range driver 14A, generally of smaller size and lower cost than woofer 14B2 is located in cabinet 12A and provides for surround channel beam-forming in combination with woofer 14B1 and tweeter 14B2. An external signal combiner such as combiner 34 of FIG. 3, provides separate signals to full-range driver 14A and crossover XOVR. Since woofer 14B1 and tweeter 14B2 are necessarily phase-aligned over the full frequency range by crossover XOVR (that generally being the goal of a crossover network), full-range driver 14A can then be used in combination with woofer 14B1 and tweeter 14B2 and calibrated such that the surround channel listening direction null is produced by the combination, and full-range driver 14A can also be optionally supplied with full-range main channel information in another phase alignment directed at the listening area, used to carry only the low frequency main channel information to improve bass response, or not supplied with main channel information at all.

The speaker arrangement of FIG. 7C provides several advantages in that a high-quality speaker cabinet 12B of the listener's choice can be supplemented with cabinet 12B to provide simulated surround sound capability. A1so, the orientation depicted provides simulated surround sound over a wider frequency range due to the differing spacings between full-range driver 14A and drivers 14B1 and 14B2 of cabinet 12B. Since the distance between tweeter 14B1 and full-range driver 14A is shorter than that between woofer 14B2 and full-range driver 14A, the lowest frequency at which beam-forming is practical is extended due to the increased driver spacing for low frequencies. Similarly, the highest frequency at which beam-forming is practical without combing is extended due to the decreased driver spacing for high frequencies. Therefore, the configuration is also advantageous when fabricating a single speaker cabinet containing all of drivers 14A, 14B1 and 14B2. Further, while manufactured cabinets tend to mount tweeter driver 14B1 away from the cabinet edge to reduce diffraction effects, in a single cabinet, it would be desirable to locate tweeter driver 14B1 very close to full-range driver 14A, so that the high frequency beam forming range is extended as far as possible.

Figure 8:
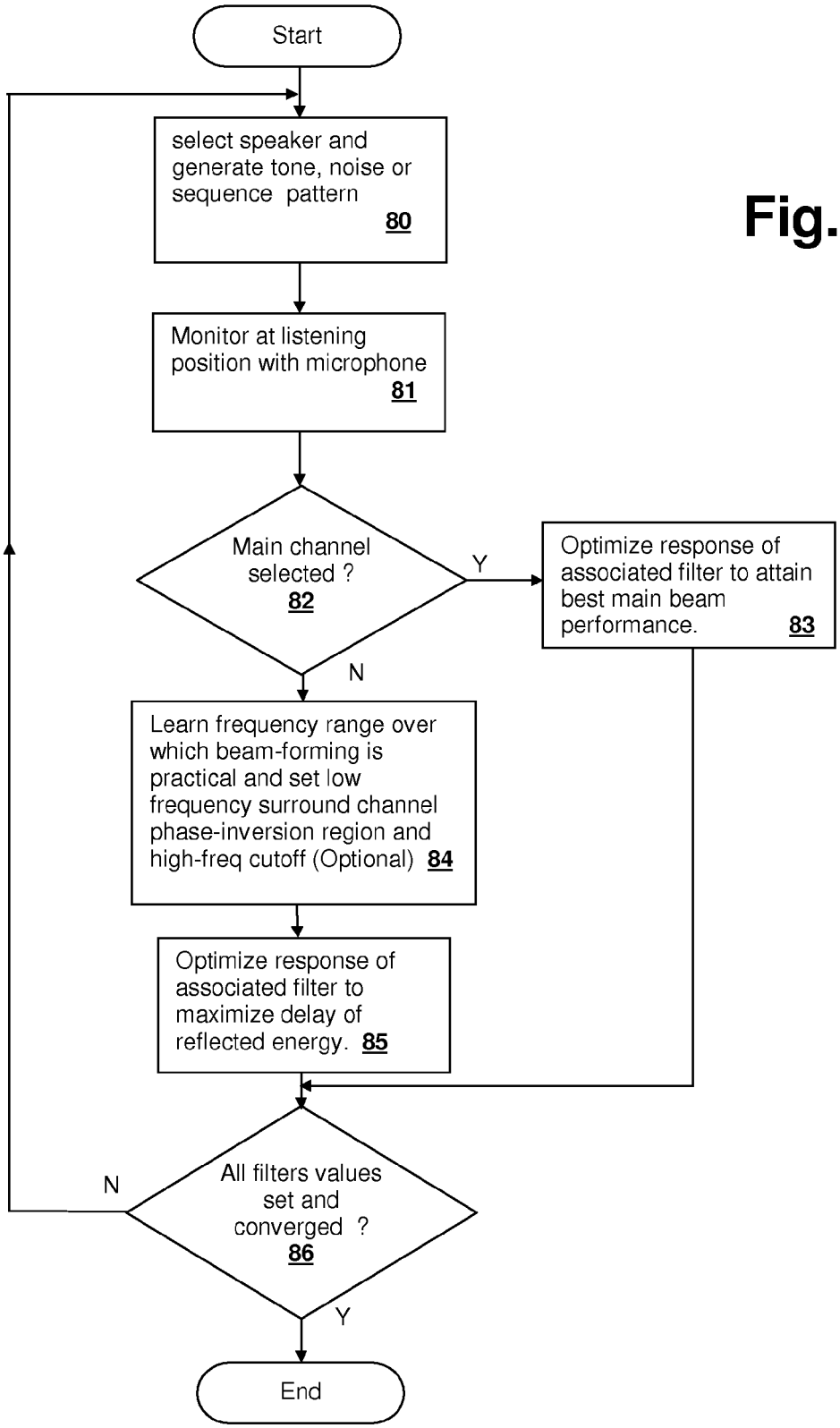
FIG. 8 is a flowchart depicting a calibration method in accordance with an embodiment of the present invention.

Referring now to FIG. 8, a flowchart depicting a calibration method in accordance with an embodiment of the present invention is shown. The illustrated method is for a single channel calibration on each pass, but the multi-channel simultaneous calibration follows the same pattern. First, an audio channel is selected and the tone, noise or sequence is generated through the corresponding channel (step 80). The listening position is monitored with a microphone (step 81) and if the channel under test is a main (direct) channel (decision 82), then the response of the channel filter is optimized to achieve the best main beam performance (step 83).

If the channel under test is a surround channel (decision 82), the overlap frequency range over which beam-forming is practical can be optionally determined (step 84) from detection of the degradation of the null at the listening position due to combing at high frequencies or lack of driver spacing at low frequencies. The low-frequency/mid-range break point can be set (i.e., the frequency at which the low-frequency in-phase addition of the surround channel information is changed to a controlled phase relationship for beam-forming away from the listening position) and likewise the upper limit for transitioning to reverberant simulation of high-frequency surround diffusion can be set. The response of the surround channel FIR filters is optimized to maximize the delay of the surround channel energy (step 85). The process from steps 80-85 is repeated over each channel (or performed simultaneously) and also iterated until all filter sets have been calibrated and the values stabilized as between all of the channels (decision 86).

The above-described calibration can be performed by summing the response of one driver in each driver pair with a time-delayed version of the other driver's response. As the delay is varied, a delay is reached having the greatest surround effect, which is determined as the above-described maximum of the ratio of late response to early response. The figure-of-merit is the ratio of late to early energy in the signal received at the microphone. A reasonable cut-off time for considering energy late vs. early for a typical room, is energy arriving more than 5 ms after the initial impulse response (direct energy) for a single speaker is considered late energy. The impulse response of the adjustable FIR filters in each channel can then be adjusted to accomplish the delay, which can be a frequency dependent delay for each driver. The direct response can also be calibrated in a similar manner, with the delay determined to minimize the reflected energy and maximize the direct (non-reflected) energy. In general, it is desirable to achieve the best main beam performance without trying to eliminate reflections, as reflections are ordinarily present for the main beam in a full surround sound installation, as well.

The description provided above constitutes a description of the preferred embodiments of the invention, but the invention is not limited to the particular implementations shown or described. Those skilled in the art, having seen the above description and accompanying drawings, will understand that changes in form, structure and other details, as well as the order of operation of any operative steps may be varied without departing from the spirit and scope of the invention.

What is claimed is:

1. A method of audio beam-forming, comprising:

providing a first signal to a first speaker driver, wherein said first signal contains main channel and surround channel information;

providing a second signal to a second speaker driver vertically displaced from said first speaker driver, wherein said second signal contains said main channel information and said surround channel information;

controlling a phase relationship between said surround channel information within said first signal and said surround channel information within said second signal to control propagation of said main channel and surround channel information in a predetermined direction toward a listening position, wherein said surround channel information is propagated with a first directivity pattern having substantial attenuation in said predetermined direction and at least one lobe having a directivity peak located substantially away from said predetermined direction, and wherein said main channel information is propagated with a second directivity pattern having a substantially peak amplitude in said predetermined direction; and separating said surround channel information into a low frequency component and a beam-forming component, and wherein said providing said first signal further comprises generating said first signal in conformity with said main channel information and said low frequency component of said surround channel information independent of said controlled phase relationship, and said beam-forming component of said surround channel information as controlled by said controlling said phase relationship.

2. The method of claim 1, further comprising controlling a phase relationship between said main channel information within said first signal and said main channel information within said second signal, such that a shape of said second directivity pattern is controlled.

3. The method of claim 1, wherein said controlling a phase relationship is performed by said first providing said surround channel information in a first polarity to said first speaker driver and second providing said surround channel information in an opposing polarity to said second speaker driver in said overlapping frequency range.

4. The method of claim 1, wherein said first and second speaker drivers are mounted in a single speaker cabinet and wherein said method further comprises:

receiving said main channel information via at least one electrical connector on said speaker cabinet; and receiving said surround channel information via said at least one electrical connector.

5. The method of claim 1, wherein said controlling said phase relationship is performed by calibrating at least one adjustable impulse response filter coupling said surround channel information to said first speaker driver.

6. The method of claim 1, further comprising separating said surround channel information into a high frequency component, and wherein said generating said first signal further generates said first signal by:

delaying said high frequency component of said surround channel information; and combining said high frequency component of said surround channel information in said first signal.

7. A system for audio beam-forming, comprising:

a first speaker driver;

a second speaker driver vertically displaced from said first speaker driver; and an electronic network for receiving surround channel information and main channel information and supplying a first signal to said first speaker driver and a second signal to said second speaker driver generated in conformity with both said surround channel information and said main channel information, and wherein said electronic network controls a frequency dependent phase relationship between surround channel information in said first signal and said second signal, wherein said surround channel information is propagated with a first directivity pattern having substantial attenuation in said predetermined direction and at least one lobe having a directivity peak located substantially away from said predetermined direction, and wherein said main channel information is propagated with a second directivity pattern having substantially peak amplitude in said predetermined direction, and wherein the electronic network further comprises at least one first filter for separating said surround channel information into a low frequency component and a beam-forming component and a combiner for combining said main channel information, said low frequency component of said surround channel information that is not controlled by said frequency-dependent phase relationship, and said beamforming component of said surround channel information as controlled by said frequency-dependent phase relationship.

8. The system of claim 7, further comprising a housing, wherein said first and second speaker drivers are mounted conformal to at least one surface of said housing, and wherein said electronic network is mounted internal to said housing.

9. The system of claim 8, wherein said housing is a housing of a consumer device having at least audio capabilities with surround channel and main channel outputs, and wherein said first speaker driver and said second speaker driver provide a simulated surround field from said consumer device.

10. The system of claim 9, wherein said consumer device is a television.

11. The system of claim 7, wherein said electronic network comprises at least one finite impulse response (FIR) filter for controlling said phase relationship by adjusting a phase of at least said first signal over frequency.

12. The system of claim 7, further comprising:

a second filter for separating said surround channel information into a high frequency component; and a delay for delaying said high frequency component of said surround channel information, and wherein said combiner further combines said high frequency component of said surround channel information in said first signal.

* * * * *